US006919540B2

(12) United States Patent
Kaastra

(10) Patent No.: US 6,919,540 B2
(45) Date of Patent: Jul. 19, 2005

(54) HEATING ELEMENT, LIQUID CONTAINER AND METHOD FOR DETECTING TEMPERATURE CHANGES

(75) Inventor: Simon Kaastra, Dinxperlo (NL)

(73) Assignee: Ferro Techniek Holding B. V. (NL)

( * ) Notice: Subject to any disclaimer, the term of this patent is extended or adjusted under 35 U.S.C. 154(b) by 0 days.

(21) Appl. No.: 10/220,992

(22) PCT Filed: Mar. 7, 2001

(86) PCT No.: PCT/NL01/00190

§ 371 (c)(1),
(2), (4) Date: Dec. 6, 2002

(87) PCT Pub. No.: WO01/67818

PCT Pub. Date: Sep. 13, 2001

(65) Prior Publication Data

US 2003/0146204 A1 Aug. 7, 2003

(30) Foreign Application Priority Data

Mar. 10, 2000 (NL) ..... 1014601

(51) Int. Cl.[7] ..... F27D 11/02; A47J 27/21; H05B 1/02

(52) U.S. Cl. ..... 219/441; 219/497; 392/480

(58) Field of Search ..... 219/438, 441, 219/490, 492, 521, 542, 543, 546, 548, 552, 553

(56) References Cited

U.S. PATENT DOCUMENTS

| | | | | | |
|---|---|---|---|---|---|
| 3,716,693 | A | * | 2/1973 | Bleckmann | 219/553 |
| 4,092,520 | A | * | 5/1978 | Holmes et al. | 219/504 |
| 6,118,102 | A | * | 9/2000 | Slegt | 219/438 |
| 6,137,089 | A | * | 10/2000 | Pragt et al. | 219/438 |
| 6,180,925 | B1 | * | 1/2001 | Moore et al. | 219/441 |

FOREIGN PATENT DOCUMENTS

| | | | |
|---|---|---|---|
| EP | 0 967 836 | A | 12/1999 |
| FR | 2 275 103 | A | 1/1976 |
| GB | 2272619 | * | 5/1984 |
| JP | 5414396 | * | 11/1979 |
| JP | 59 204775 | A | 11/1984 |
| JP | 03226988 | * | 10/1991 |
| JP | 10020708 | * | 1/1998 |
| WO | 02096155 | * | 11/2002 |

* cited by examiner

*Primary Examiner*—Joseph Pelham
(74) *Attorney, Agent, or Firm*—The Webb Law Firm. P.C.

(57) ABSTRACT

The invention relates to a heating element with at least one electrical resistance, wherein between a surface for heating and the electrical resistance is situated a dielectric, onto which dielectric connects an ammeter for detecting a leakage current. In addition, the invention comprises a liquid container provided with such a heating element. The invention also relates to a method for detecting a temperature change in a heating element formed by an electrical resistance by measuring a leakage current discharged by a dielectric connected to the heating element.

26 Claims, 2 Drawing Sheets

HEATING ELEMENT, LIQUID CONTAINER AND METHOD FOR DETECTING TEMPERATURE CHANGES

BACKGROUND OF THE INVENTION

1. Field of the Invention

The invention relates to a heating element formed by an electrical resistance, to a liquid container provided with such a heating element, and to a method for detecting a temperature change in a heating element formed by an electrical resistance.

2. Description of the Prior Art

The heating of heating elements, as applied for instance for heating liquid in liquid containers or heating of hot plates, takes place according to the prior art with for instance electrical resistances which are heated by current feed. Examples hereof are for instance a heating spiral which is placed in the liquid container and an electrically heated grill plate. In order to prevent overheating of the heating element such as can for instance in the case of boiling-dry or accumulated scale, the prior art electrical heating elements are usually provided with a separate temperature sensor such that the current feed of a heating element can be limited when the temperature rises too high. The drawbacks of the existing heating elements are that they are usually situated in the liquid for heating, that there is a relatively great risk of undetected overheating and/or that separate provisions have to be made for temperature monitoring.

The object of the invention is to provide an improved heating element and method with which the above stated drawbacks can be prevented while retaining the advantages of the prior art.

SUMMARY OF THE INVENTION

The invention provides for this purpose a heating element formed by an electrical resistance, wherein between a surface for heating and the electrical resistance is situated a dielectric, a leakage current of which can be detected by means of an ammeter. The ammeter can be electrically coupled for this purpose directly to the dielectric, but it is also possible for the ammeter to be electrically coupled to the dielectric via a medium for heating. The surface for heating is herein preferably manufactured from a heat-conducting (and usually also electrically conducting) material, and is mounted in electrically insulated manner, or at least mounted in insulated manner such that a leakage current through the dielectric can only be discharged via the ammeter. The earthing of the heating element likewise runs only via the ammeter, which must be dimensioned for this purpose such that the capacity for current feed is sufficiently great in accordance with the standards applicable thereto (for instance IEC 60335). In the case of an electrically conducting surface for heating it is possible for the ammeter for detecting a leakage current through the dielectric to connect onto the dielectric itself or, when mounted in electrically insulated manner, onto the surface for heating. By means of the dielectric the electrical resistance is electrically insulated relative to the wall of the surface for heating. A leakage current coming from the heating element will flow through the dielectric, which current will depend partly on the resistance of the dielectric. Research has shown that a dielectric can be applied which has a resistance that can depend inter alia on the temperature of the dielectric. If the resistance of the dielectric at varying temperatures is known, a temperature of the dielectric can be determined by detecting the leakage current, at least when the voltage over the heating element remains more or less constant or is at least also known. The leakage current, which can be detected in simple manner with an ammeter, thus forms a measurement value with which the temperature of the dielectric, and therefore the heating element and/or the electrical resistance, can be determined. An additional temperature sensor is therefore unnecessary, while the heating element can be assembled with a surface for heating in very simple manner, preferably such that the heating element is situated on the side remote from the side of the surface for heating to be utilized for heating purposes. When the heating element is assembled with a surface for heating manufactured from an electrically conducting material and this is also electrically insulated relative to outside objects, the leakage current passing through the dielectric can also be measured on the surface for heating or an electrically conducting component connected thereto. In yet another variant the surface for heating makes contact with a liquid for heating, in which case the leakage current can also be measured on this liquid (the liquid will of course form an extra resistance here). Use can also be made of the liquid to earth such a liquid container.

While it is the case that the French patent application FR 2 275 103 describes a heating device constructed from a plurality of functional layers including a dielectric layer, there is however no reference to coupling of an ammeter to this layer for detecting that a determined temperature has been reached. The described heating device comprises an insulating layer, a metal layer, a dielectric layer and a heating element. An insulating gasket is arranged round these layers.

In a preferred embodiment the capacitive current of a power supply of the electrical resistance is shifted through 90° relative to the voltage over the electrical resistance. When with such a power supply the time of measurement is determined at a moment that the leakage current is maximal, the capacitive current part will then be zero. The consequence hereof is that the leakage current measurement can be performed relatively accurately, whereby the temperature of the dielectric can also be determined relatively accurately. The power supply according to the present preferred embodiment therefore increases the accuracy with which the temperature of the dielectric can be determined.

Particularly favourable results are realized with a dielectric manufactured from glass ceramic or kerdi® which contains in total less than 10% by weight of alkali metals such as sodium, potassium and lithium. Glass ceramic or kerdi® containing a total of more than 10% by weight of alkali metals can however also be used if for instance a leakage current detection is desired at temperatures lower than 200° C. A glass ceramic or kerdi® can be applied in relatively advantageous manner to a surface for heating, and can also take a very wear-resistant form. The conductivity of the dielectric can be readily determined by making variations in the alkali content of the glass ceramic or kerdi® and/or by adding determined quantities of one or more of the additives zirconium oxide, zirconium silicate or quartz. The glass ceramic or kerdi® preferably contains a total of 1 to 3% by weight of titanium oxide and zinc oxide, which also makes it suitable for higher power densities. A dielectric can for instance be created by means of these additives which is suitable for higher power densities, and the resistance of which suddenly declines sharply at a determined temperature, such as for instance a temperature around 200–250° C. Overheating (for instance through boiling-dry or excessive deposition of scale) of a heating element can thus be detected in clear manner. In a particular preferred embodiment the heating element can also be provided with a plurality of dielectric layers with mutually differing properties, so that different temperature ranges can be accurately determined. These layers can for instance be applied on two sides in relation to an electrically conducting track to be heated.

A particular preferred embodiment of the heating element comprises a melt resistance, formed for instance by a narrowed portion of smaller cross-section. As the temperature of the heating element rises, this narrowed portion will be the first to bring about an interruption if the power supply is not limited, whereby further current feed, and thus further heating, becomes impossible. The melt resistance therefore forms an additional protection against overheating if a limitation of the power supply does not already take place on the basis of the increasing leakage current through the dielectric. In addition to the embodiment of the melt resistance as narrowed portion, other embodiments can also be envisaged such as a soldered feed with a defined melting point which is lower than the melting point of the remaining part of the electrical resistance. It is also possible to couple the ammeter to a control for the heating element such that when a determined threshold value in the leakage current level is reached the power supply to the heating element is reduced or interrupted. Excessive overheating can be prevented in this manner.

The invention also provides a liquid container provided with a heating element as described above, wherein the liquid container is a through-flow heating element such as for instance a tube or pipe. It is also possible for the liquid container to be embodied as a liquid container such as a kettle in which a still or moving liquid is heated. Electrical heating elements can be applied particularly advantageously in combination with a liquid container.

The invention also provides a method for detecting a temperature change in a heating element formed by an electrical resistance by measuring the leakage current discharged by a dielectric connected to the heating element. The leakage current through the dielectric can herein be measured on an electrically conducting surface for heating which connects onto the dielectric, via an electrically conducting medium for heating or directly on the dielectric. Depending on the conditions in which the method is applied, the most advantageous method of measurement in these specific conditions can be selected. The advantages of applying this method have already been described above with reference to the heating element and the liquid container according to the invention.

BRIEF DESCRIPTION OF THE DRAWINGS

The present invention will be further elucidated with reference to the non-limitative embodiments shown in the following figures. Herein.

DETAILED DESCRIPTION OF THE PREFERRED EMBODIMENTS

Figure 1:
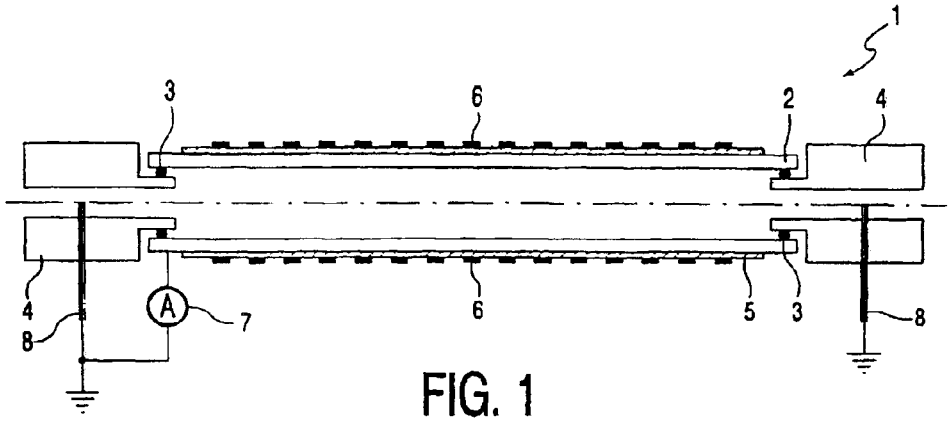
FIG. 1 shows a cross-section through a device according to the invention.

FIG. 1 shows a liquid container 1 of a through-flow type which consists of an electrically conducting, for instance steel tube 2 which is mounted via gaskets 3 in electrically insulated manner between two plastic bushes 4.

To the outer side of tube 2 is applied a dielectric layer 5 which consists of for instance glass ceramic or kerdi® or enamel glass. On the side of the dielectric layer 5 remote from tube 2 is situated an electrically conducting track 6 which forms part of the heating element. By supplying power through the conductive track 6 the dielectric layer 5 and tube 2 will be heated, which heat is subsequently transferred to a liquid in liquid container 1. As already described above, the resistance of dielectric layer 5 will fall sharply when a determined temperature is exceeded. By connecting an earthed ammeter 7 to tube 2 the leakage current coming from the heating element can be measured. When a determined temperature is exceeded, the leakage current will increase sharply due to the decreased resistance of dielectric layer 5, so that this can be detected by ammeter 7. For earthing of liquid in liquid container 1 earthing elements 8 are placed through the plastic bushes 4 such that they can enter into contact with liquid located in liquid container 1. Not shown in this figure is that ammeter 7 can be coupled to a control for the power supply to heating element 6.

Figure 2:
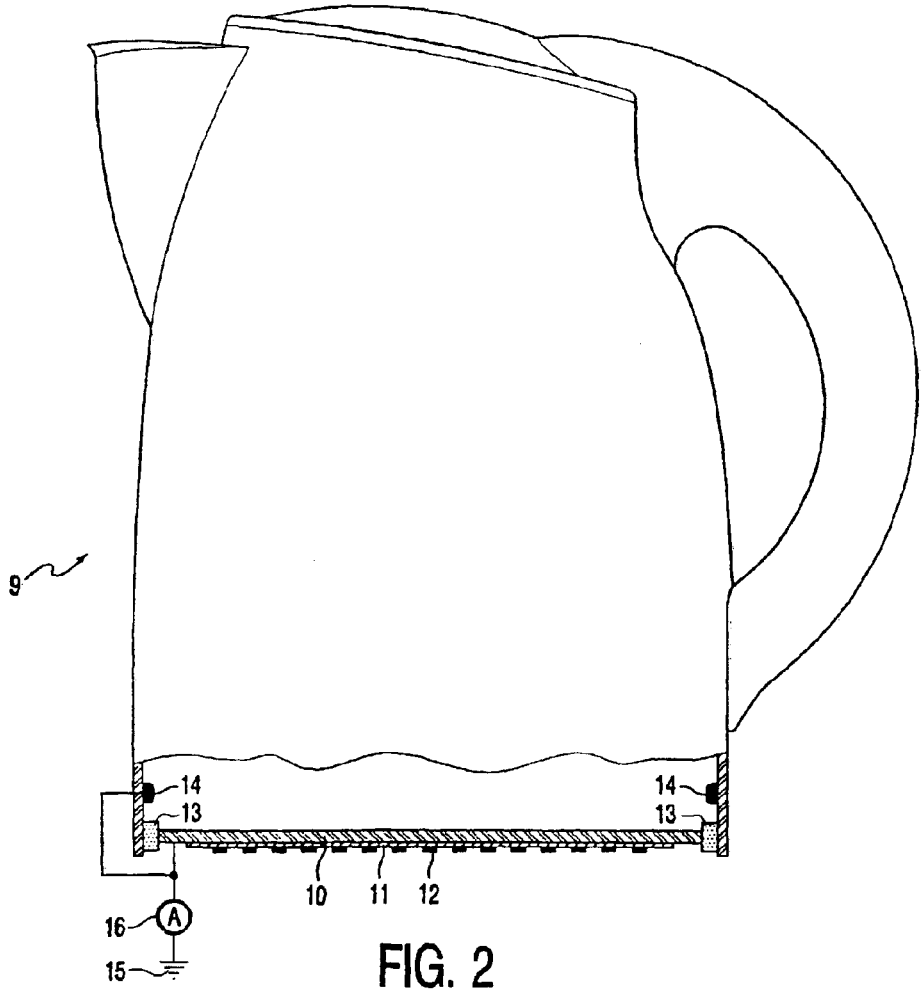
FIG. 2 shows a cross-section through another embodiment of a device according to the invention.

FIG. 2 shows a cross-section through a water kettle 9 which is provided with an electrically conducting base plate 10. On the side remote from water kettle 9 the base plate 10 is provided with a dielectric layer 11 on which electrical tracks 12 of a heating element are arranged on the side remote from base plate 10. For an electrically insulated mounting of base plate 10 in water kettle 9 the edges of base plate 10 engage on an electrically insulating gasket 13. This latter can optionally also be omitted, for instance if the housing of water kettle 9 is manufactured from an electrically insulating material. For earthing of the liquid in water kettle 9 there is arranged close to base plate 10 an electrically conducting ring 14 which is coupled via an ammeter 16 to the earth 15. For direct measurement of the leakage current through dielectric layer 11 an ammeter 16, which is earthed, connects onto base plate 10. As an alternative (not shown), it is also possible for an ammeter 16 to connect directly onto the dielectric layer 11, which may be necessary for instance if base plate 10 is manufactured from a non-electrically conducting material. According to yet another alternative, likewise not shown, it is also possible to measure the leakage current only via the electrically conducting ring 14, in which case the leakage current must be conducted through a medium located in water kettle 9. For the operation of water kettle 10 reference is made to the operation of liquid container 1 as described with reference to FIG. 1. By means of ammeter 16 it is for instance possible to detect that water kettle 9 is boiling dry or that a determined quantity of scale has adhered to base plate 10.

Figure 3:
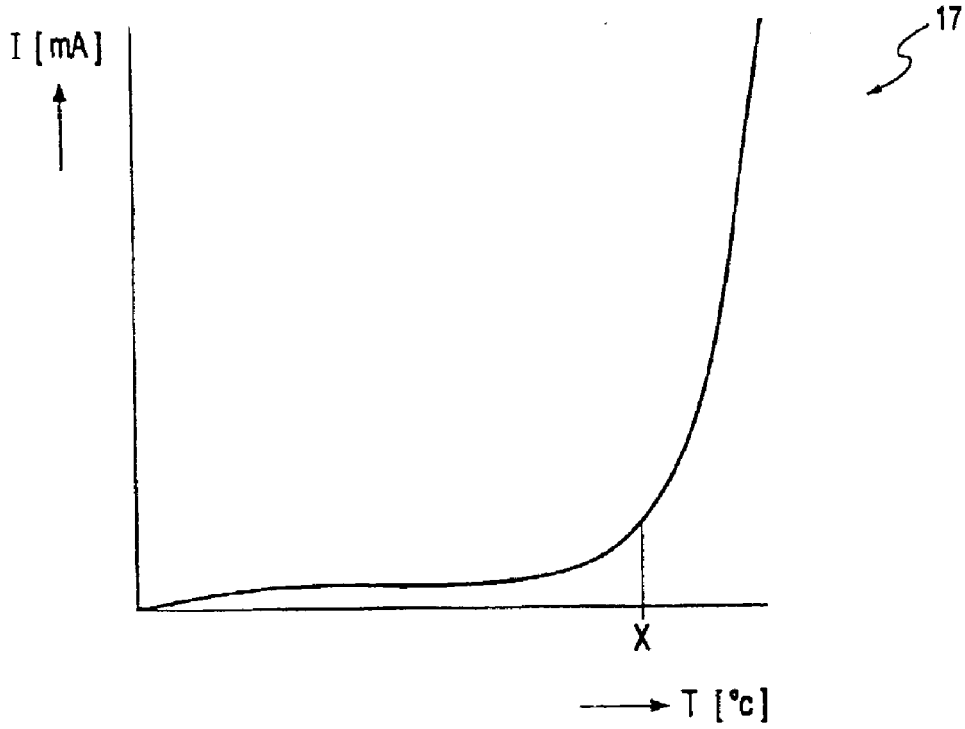
FIG. 3 shows a schematic view of a leakage current curve of a dielectric.

Finally, FIG. 3 shows a graph 17 of a leakage current curve wherein the temperature (T) is plotted on a horizontal axis against a leakage current (I) on the vertical axis. It can clearly be seen that the leakage current remains limited up to a point close to a determined temperature (X), above which temperature the leakage current increases very rapidly. The leakage current increase close to the temperature X is a consequence of the sharply falling resistance at this temperature of the dielectric which is being used. The height of temperature X and the shape of graph 17 are determined by the composition of dielectric layer 5, 11. Particularly for application in liquid heating it is possible by means of the described additive substances to obtain a sharp increase in the leakage current in the range 200–250° C.

Although the invention is described on the basis of only a few embodiments, it will be apparent to all that the invention is by no means limited to the described and shown embodiments. The invention can thus also be applied in heating elements which, other than in the shown embodiments, do not consist of an element based on thick-film technique. An example of such another construction is a heating element consisting of an electrical heating wire situated in a tube filled with a dielectric. The dielectric can for instance consist of magnesium oxide. Many other variations are however still possible for the skilled person within the scope of the invention.

What is claimed is:

1. A liquid container comprising a heating element, the heating element comprising at least one electrical resistance, a surface for heating, and a dielectric between the surface for heating and the electrical resistance, and an ammeter directly coupled electrically to the dielectric for measuring a leakage current wherein resistance of the dielectric has a sharp decrease, and the leakage current has a sharp increase, in the temperature range of 200–250° C.

2. The liquid container as claimed in claim 1, wherein the electrical resistance of the heating element is an electrically conducting material mounted on the dielectric.

3. The liquid container as claimed in claim 2, wherein the ammeter for detecting a leakage current through the dielectric connects onto the surface for heating.

4. The liquid container as claimed in claim 1, further comprising a power supply connected to the electrical resistance, wherein capacitive current of the power supply is shifted through 90° relative to the voltage over the electrical resistance.

5. The liquid container as claimed in claim 1, wherein the dielectric is formed by glass ceramic or kerdi®.

6. The liquid container as claimed in claim 5, wherein the glass ceramic or kerdi® contains in total less than 10% by weight of alkali metals such as sodium, potassium and lithium.

7. The liquid container as claimed in claim 5, wherein the glass ceramic or kerdi® contains one or more of the additives zirconium oxide, zirconium silicate or quartz.

8. The liquid container as claimed in claim 5, wherein the glass ceramic or kerdi® contains a total of 1 to 3% by weight of titanium oxide and zinc oxide.

9. The liquid container as claimed in claim 1, wherein the electrical resistance comprises a melt resistance, formed for instance by a narrowed portion of smaller cross-section.

10. The liquid container as claimed in claim 1, wherein the ammeter is coupled to a control for the heating element.

11. The liquid container as claimed in claim 1, wherein the liquid container is a through-flow heating element.

12. The liquid container as claimed in claim 1, wherein the liquid container is a kettle.

13. The liquid container as claimed in claim 11, wherein the heating element is an elongated hollow conduit through which fluid moving through the conduit flows over the surface for heating and the ammeter is connected to the dielectric.

14. The liquid container as claimed in claim 1, wherein the surface for heating is a planar surface.

15. The liquid container as claimed in claim 1, wherein the dielectric is in contact with the surface for heating and the electrical resistance.

16. The liquid container as claimed in claim 1 wherein the dielectric is a first dielectric and further comprising a second dielectric.

17. The liquid container as claimed in claim 16 wherein the first dielectric is on one side of the electrical resistance and the second dielectric is on opposite side of the electrical resistance.

18. A heating element comprising at least one electrical resistance, a surface for heating, a dielectric between the surface for heating and the electrical resistance, and an ammeter coupled electrically to the dielectric via a medium for heating to detect leakage current through the dielectric.

19. A method for detecting a temperature change of a heating element of a liquid container, comprising the steps of providing a heating element comprising at least one electrical resistance, a surface for heating the liquid, and a dielectric between the surface for heating and the electrical resistance, wherein resistance of the dielectric has a sharp decrease, and leakage current has a sharp increase, in the temperature range of 200–250° C.; coupling electrically an ammeter to the dielectric, and measuring a leakage current discharged by the dielectric to detect temperature change of the heating element.

20. The method as claimed in claim 19, wherein the surface for heating is an electrically conducting surface and the dielectric is a first dielectric and further comprising the step of providing the heating element with a second dielectric.

21. The method as claimed in claim 19, wherein the dielectric is in contact with the surface for heating and the electrical resistance.

22. The method as claimed in claim 20 wherein the step of providing a heating element comprising at least one electrical resistance, a surface for heating the liquid, and a dielectric between the surface for heating and the electrical resistance comprises the step of applying the first dielectric on one side of the electrical resistance and the step of providing the heating element with a second dielectric comprises the step of applying the second dielectric on opposite side of the electrical resistance.

23. A method for detecting a temperature change in a heating element formed by an electrical resistance, comprising the step of measuring a leakage current discharged by a dielectric connected to the heating element, wherein the leakage current through the dielectric is measured via an electrically conducting medium for heating.

24. A liquid container, wherein the liquid container is a through-flow heating element comprising an elongated hollow conduit, at least one electrical resistance, a surface for heating wherein fluid moving through the conduit flows over the surface for heating, a dielectric between the surface for heating and the electrical resistance, and an ammeter connected to the dielectric for measuring a leakage current, wherein the conduit has a first end and a second end, and further comprising an electrically insulating bushing mounted at each of the ends of the conduit and a gasket between conduit interior and exterior portions of the bushing in the end of the conduit.

25. The liquid container as claimed in claim 24, further comprising an electrically conducting member in at least one of the bushings, wherein one end of the at least one conducting member is in the conduit interior spaced from the surface for heating and the other end of the at least one conducting member is exterior of the bushing.

26. A kettle comprising:

a heating element, the heating element comprising at least one electrical resistance, a surface for heating, and a dielectric between the surface for heating and the electrical resistance;

an ammeter connected to the heating element for measuring a leakage current; and an electrically conducting member having one end in the kettle interior spaced from the surface for heating and the other end external of the kettle interior.

* * * * *